United States Patent [19]

Schmitz

[11] Patent Number: 4,642,835

[45] Date of Patent: Feb. 17, 1987

[54] TWO-SIDED BRUSH AND CONTAINER

[76] Inventor: Bertram Schmitz, 55 Harbour Square, Suite 1214, Toronto, Ontario, Canada, M5J 2L1

[21] Appl. No.: 778,974

[22] Filed: Sep. 23, 1985

[51] Int. Cl.[4] ..... A47L 13/12; A47L 23/04; A47L 25/08

[52] U.S. Cl. ..... 15/104 A; 15/114; 15/161; 15/184; 206/229; 220/4 C; 220/353

[58] Field of Search ..... 15/104 A, 105, 106, 15/114, 161, 184, 258, DIG. 11; 206/229; 220/4 C, 353

[56] References Cited

U.S. PATENT DOCUMENTS

| | | | |
|---|---|---|---|
| 1,469,643 | 10/1923 | Hovey | 15/105 |
| 2,618,006 | 11/1952 | Morris | 15/258 |
| 2,695,416 | 11/1954 | Raimo | 15/106 |
| 2,715,742 | 8/1955 | Coles | 15/104 A X |
| 2,743,474 | 5/1956 | Johnson | 15/258 |
| 2,986,762 | 6/1961 | Webb | 15/258 X |
| 3,485,408 | 12/1969 | Benesch | 220/4 C |
| 3,967,338 | 7/1976 | Russell | 15/185 |

FOREIGN PATENT DOCUMENTS

| | | | |
|---|---|---|---|
| 999111 | 11/1976 | Canada | 15/105 |

*Primary Examiner*—Wm. Carter Reynolds
*Attorney, Agent, or Firm*—Sim & McBurney

[57] ABSTRACT

A body member has a lint brush projecting from one side thereof and a shoe polishing brush projecting from the other side thereof. Both brushes are enclosed by identical covers that are latched to the body member. The covers each have a projection at one end thereof that requires that the covers be mounted on the body member with these projections at opposite ends of the body member. The latches which secure the covers to the body members indicate which cover will be removed by which latch and comprise cantilevered fingers formed integral with the body member.

16 Claims, 11 Drawing Figures

FIG. 1
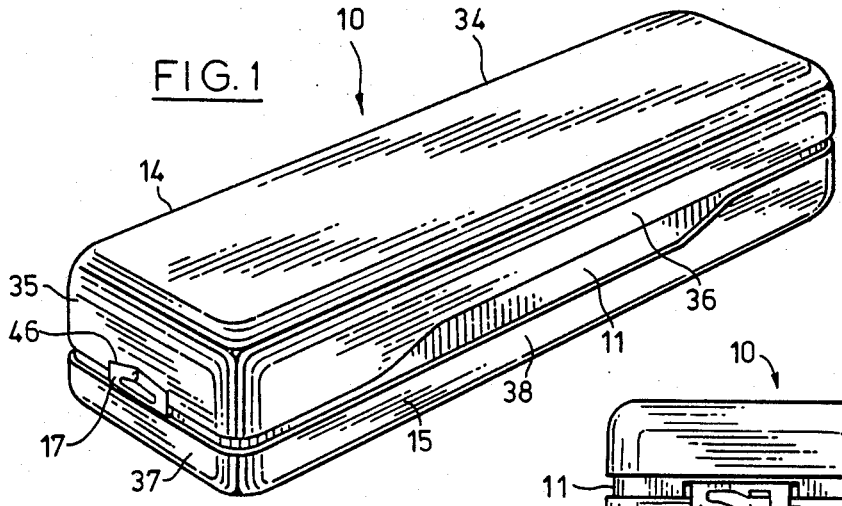
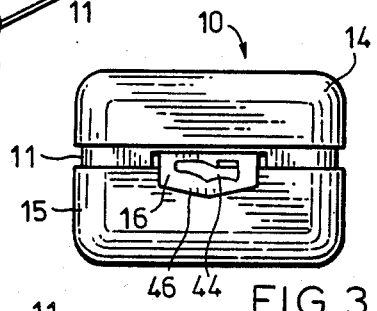
FIG. 3
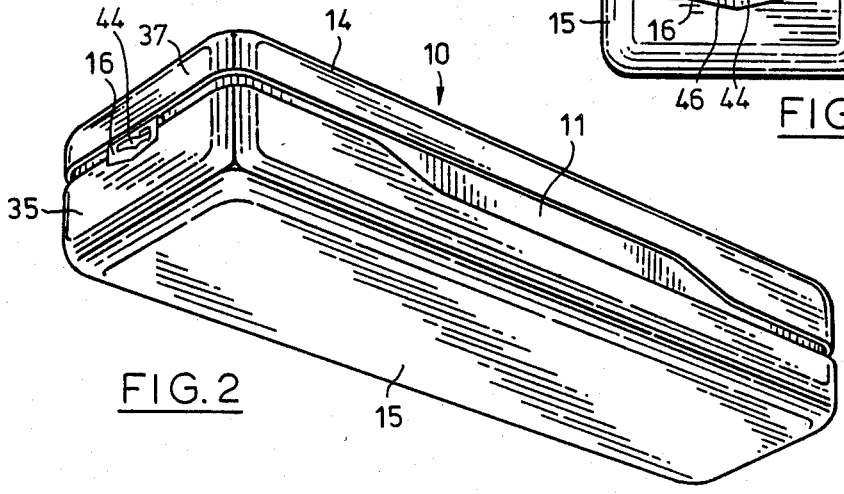
FIG. 2
FIG. 4
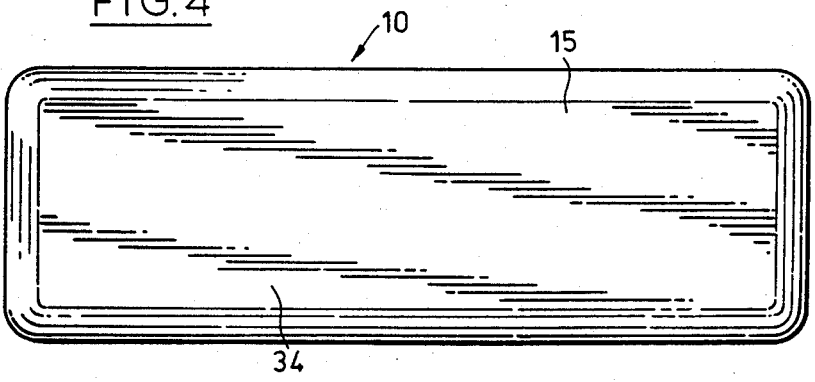

TWO-SIDED BRUSH AND CONTAINER

BACKGROUND OF THE INVENTION

This invention relates to a two-sided brush and container therefor. More particularly, this invention relates to a two-sided brush having one brush surface that is adapted to polish shoes and another brush surface that is adapted to remove lint from clothes.

Persons travelling away from home often have need of a brush for removing lint from clothes and a brush for polishing shoes. Numerous brushes that will serve these individual functions are available, but it would be desirable, in order to minimize the space that they occupy in a suitcase or the like, to combine into a single, compact container brushes that will perform both of the aforementioned functions.

There is shown in U.S. Pat. No. 2,618,006, issued Nov. 18, 1952 to L. F. Morris a shoeshine kit comprising a body member having separate brushes projecting from opposite sides thereof and two separate covers that latch with the body member and cover the two brushes. One problem with the shoeshine kit of Morris is that no means are provided for selectively removing the covers. In other words, which cover will become unlatched from the body member when an attempt is made to pull the two covers apart from each other is not predictable. This is inconvenient since, if one wishes to use a lint brush rather than a shoe polishing brush, or vice versa, it would be desirable to have predictable access to the desired brush, not access by chance.

Another shoeshine kit is shown in U.S. Pat. No. 2,743,474, issued May 1, 1956 to C. E. Johnson. The Johnson shoeshine kit has separate latching arrangements on its separate covers, so which cover is to be removed can be predetermined, but the latching arrangements are complex and are both located at the same end of the kit, and that kit itself is quite bulky.

SUMMARY OF THE INVENTION

An aspect of the invention is as follows:

A two-sided brush and container therefor comprising a body member having first and second oppositely disposed ends and first and second oppositely disposed faces; a first brush affixed to and extending from said first face; a second brush affixed to and extending from said second face and thus being oppositely disposed to said first brush; first and second covers respectively cooperating with said body member to house said first and second brushes respectively in first and second compartments respectively formed between said first cover and said body member and between said second cover and said body member respectively, each of said covers at one end thereof being of greater depth than at the other end thereof, such that if said covers are mounted on said body member with the deeper ends adjacent to each other, said deeper ends will abut each other and preclude said covers from being latched to said body member; first and second latch members at said first and second ends respectively of said body member, said first latch member being formed integral with said body member and comprising a cantilevered finger having a first detent thereon engageable with a second detent on said first cover, said second latch member being formed integral with said body member and comprising a cantilevered finger having a third detent thereon engageable with a fourth detent on said second cover; and detent means on said body member and on said cover members remote from said first and third detents and from said second and fourth detents respectively for removably securing said covers to said body member.

BRIEF DESCRIPTION OF THE DRAWINGS

FIG. 1 is a perspective view of a brush and container embodying the present invention;

FIG. 2 is a similar view to that shown in FIG. 1 but with the brush and container of FIG. 1 reversed end for end and with the view being from the underside rather than from the upper side, as in FIG. 1;

FIG. 3 is an end view of the brush and container shown in FIG. 2;

FIG. 4 is an elevation of the brush and container of FIG. 1;

DETAILED DESCRIPTION OF THE INVENTION INCLUDING THE PREFERRED EMBODIMENT

Figure 5:
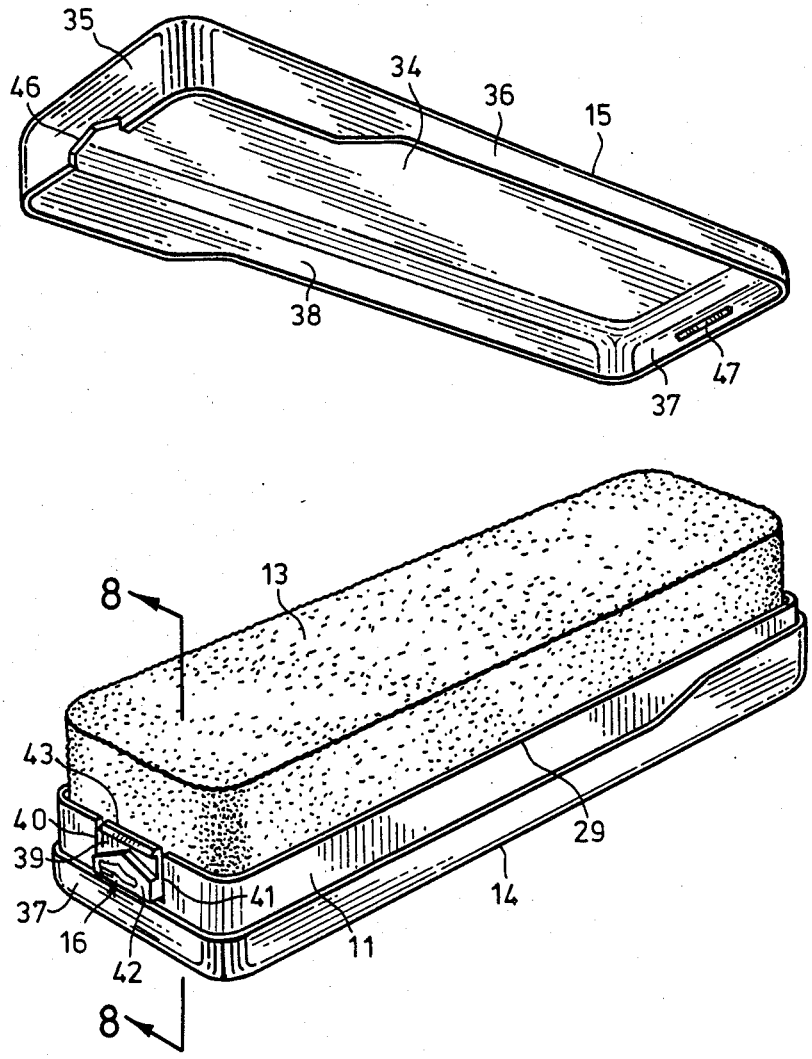
FIGS. 5 and 6 are views of the brush and container with opposite covers thereof removed.

A brush and container 10 embodying the present invention forms a compact kit that can be packed easily in a suitcase or the like. It includes a body member 11 having a lint brush 12 (FIG. 6) affixed thereto and projecting from one side thereof and a shoe polishing brush 13 (FIG. 5) affixed thereto and projecting from the opposite side thereof; two identical covers 14 and 15; and two identical latch members 16 and 17 formed integral with body member 11 and located at opposite ends of the body member.

Figure 7:
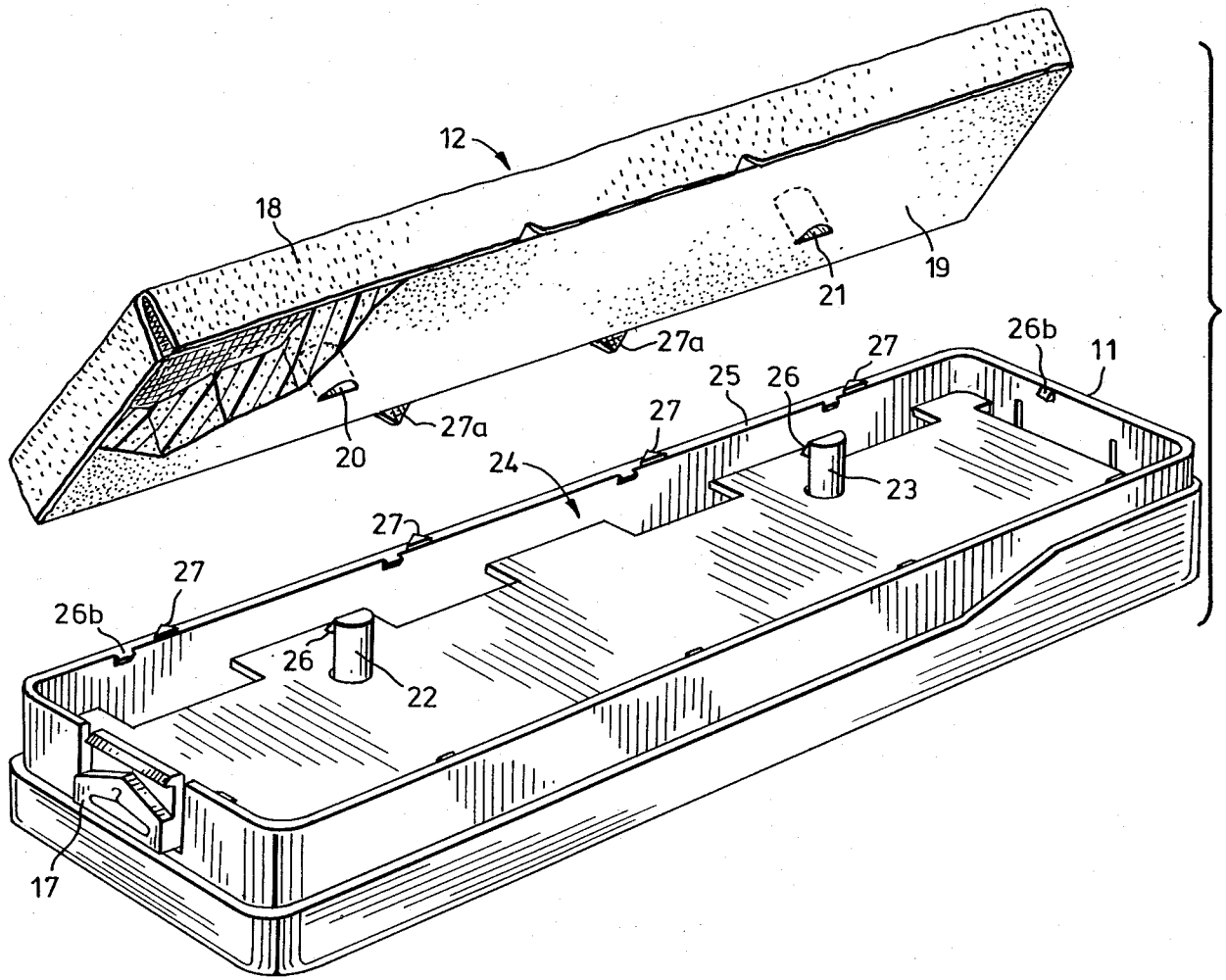
FIG. 7 is a detailed view showing how the lint brush is affixed to the body member of the brush and container.

Lint brush 12 employs a brush material 18 of known type that must be moved in one direction to remove lint from clothes and which can be cleaned by moving the brush material in the opposite direction against a cloth or other piece of material having a relatively rough surface. As shown in FIG. 7, brush material 18 is glued or otherwise affixed to a block 19 of spongy material, e.g., foamed polyurethane, that is provided with two openings 20 and 21. These openings are displaced to one side of block 19 and register with upstanding pins 22 and 23 respectively located in a cavity 24 formed in one side of body member 11. Cavity 24 receives block 19, the depth of cavity 24 and the depth of block 19 being such that brush material 18 covering the major surface of block 19 projects beyond the plane of rim 25 of body member 11. Pins 22 and 23 each are provided with projections 26 that engage block 19 and hold it in place in cavity 24. Barbs **26*b* formed integral with body member 11 also assist in holding lint brush 12** in place.

On one side of rim 25 there are arrowheads 27 that indicate to the user the direction in which brush material 18 must be moved in order to clean lint from clothing. The displacement of openings 20 and 21 to one side of block 19, and the displacement of pins 22 and 23 to one side of body member 11 ensure that brush 12 can be mounted in only one way in cavity 24. All then that is necessary is to ensure that brush material 18 is properly mounted on block 19 relative to openings 20 and 21, so that when brush 12 is mounted in cavity 24, the direction that brush 12 must be moved to remove lint from clothes is indicated by arrowheads 27. To ensure that brush material 18 is properly mounted on block 19 it is provided with pointed tabs **27*a* when the material is cut, and material 18 is mounted on block 19 with these adjacent to openings 20 and 21**.

Figures 10, 11:
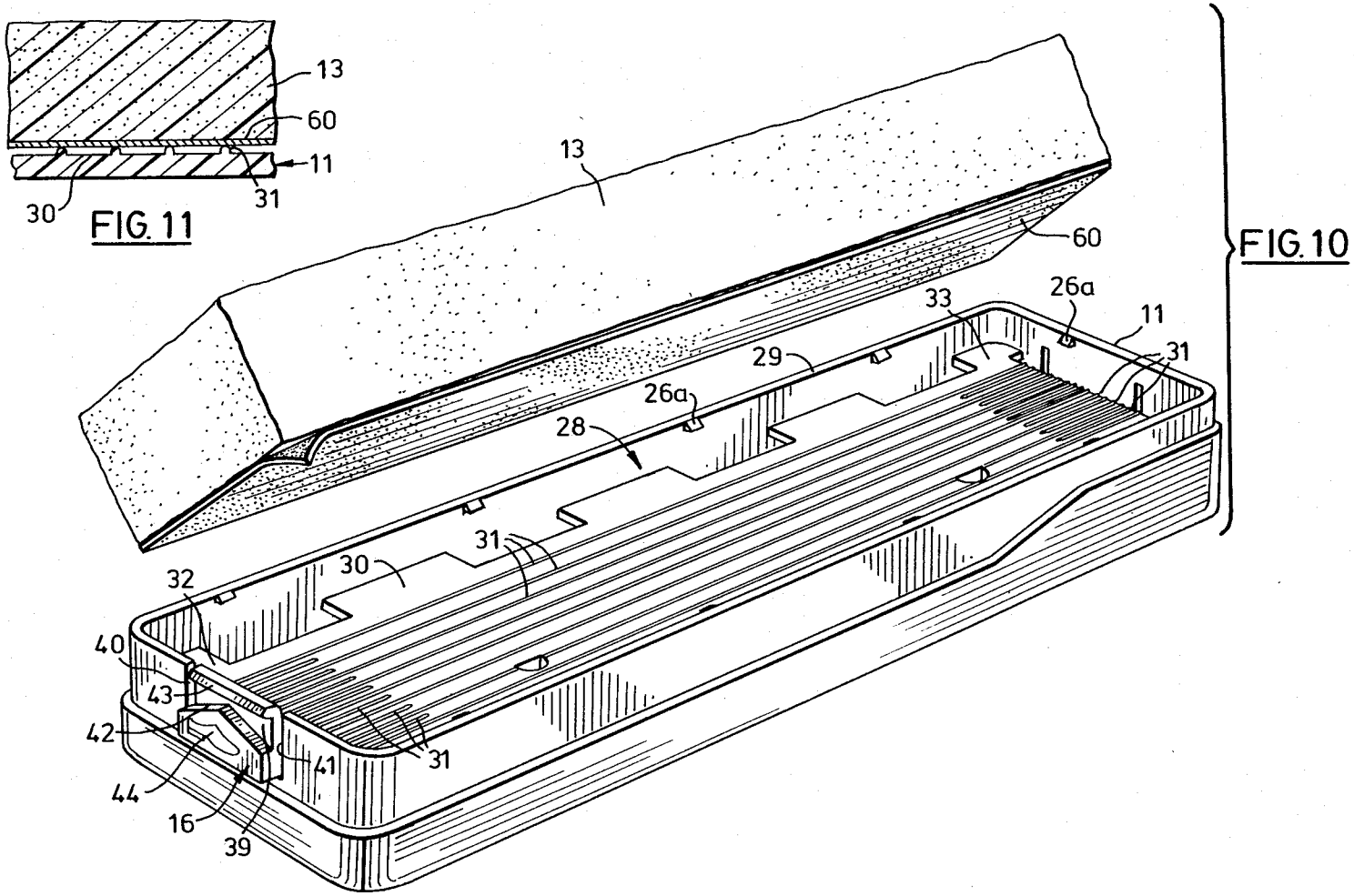
FIG. 10 is a detailed view showing how the shoe polishing brush is affixed to the body member.
FIG. 11 is a detailed, transverse sectional view through certain of the components shown in FIG. 10.

Shoe polishing brush 13 is a rectangular block of a compressible, resilient, spongy material such as a low density foam. As shown in FIG. 10, it fits into a cavity 28 formed in the opposite side of body member 11 from cavity 24. It projects substantially beyond the rim 29 of body member 11 that is opposite to rim 25 thereof.

Brush 13 is impregnated with any conventional shoe polishing material, e.g., neutral silicones and waxes.

As shown in FIG. 10, brush 13 may be secured to surface 30, which is the bottom surface defining cavity 28, by means of double-sided tape 60. However, a unique arrangement is provided to facilitate removal of brush 13 when it needs to be replaced. Thus, surface 30 is provided with a plurality of longitudinally extending, upstanding ribs 31. Some of these extend the whole length of surface 30, while others are located only at the two ends 32 and 33 of surface 30 making the rib density higher at these ends than at the centre of surface 30. The underside of double-sided tape 60 tends to adhere to ribs 31, rather than to the whole of surface 30, and this makes it easier to "peel" brush 13 away from surface 30 starting at either end 32 or 33. Barbs **26*a* formed integral with body member 11 also assist in holding brush 13** in place.

Body member 11 and covers 14 and 15 preferably are formed of plastics material and may be injection molded.

Each cover member is identical, except for the symbols on the latch members. Each cover member has an end wall 34 and four downwardly depending side walls 35, 36, 37 and 38 formed integral therewith and extending at right angles thereto. At one end of each cover member wall 35 and parts of walls 36 and 38 adjacent to wall 35 extend below wall 37 and parts of walls 36 and 38 adjacent to wall 37 at the other end of the cover member. This is to ensure that as long as one cover member is in place, the other cover member can be secured to body member 11 in only one way. In this respect, if cover member 15 is reversed in position (turned end-for-end) from the position thereof shown in FIG. 1, the two higher side walls 35 will abut each other and prevent covers 14 and 15 from latching with body member 11. This is important in order to ensure that polish or cleaner from brush 13 is not transferred via a cover member to lint brush 12.

Latch members 16 and 17 are, with the exception of the indicia thereon, identical, so only one will be described, say, latch member 16. Basically it is a cantilevered finger 39 (see FIGS. 5 and 10) formed by spaced-apart, parallel slits 40 and 41 and having an arrowhead 42 formed integral therewith and an outwardly extending projection 43 at the free end of the finger.

Arrowhead 42 points to the cover (cover 15) that will be released by depressing finger 39 adjacent projection 43. An indicia 44 in the form of a shoe may be formed in arrowhead 42 to indicate that cover 15 covers shoe polishing brush 13. In the corresponding arrowhead of latch member 17 a clothes hanger may be depicted to indicate that cover 14, to which the arrowhead of latch member 17 points, covers lint brush 12.

Figure 9:
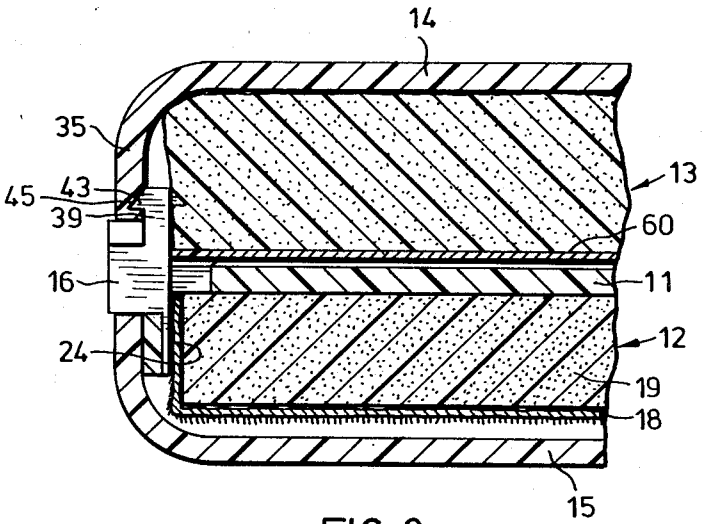
FIG. 9 is a similar section to that shown in FIG. 8 but with both covers in position.
Figure 8:
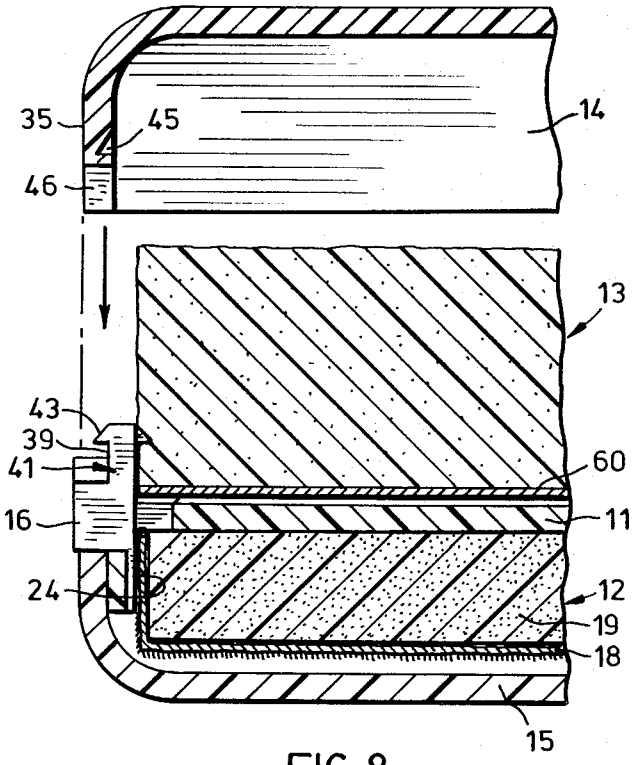
FIG. 8 is a section taken along line 8—8 in FIG. 5.

As shown in FIGS. 8 and 9, projection 43 of finger 39 engages in a recess 45 in side wall 35 of cover 14. Likewise, the corresponding projection of the corresponding finger of latch member 17 engages in a corresponding recess 45 in side wall 35 of cover 15.

Each cover has a recess 46 (FIGS. 5 and 6) in its side wall 35 that accommodates an arrowhead of one of the latch members. In addition, each cover has a recess 47 (FIG. 5) in its side wall 37 that accommodates a projection 48 (FIG. 6) at each end of body member 11, these projections being remote from the free ends of latch members 16 and 17 respectively and adjacent rims 25 and 29 respectively.

When not in use, the kit embodying this invention is in the form shown in FIGS. 1–4.

Figure 6:
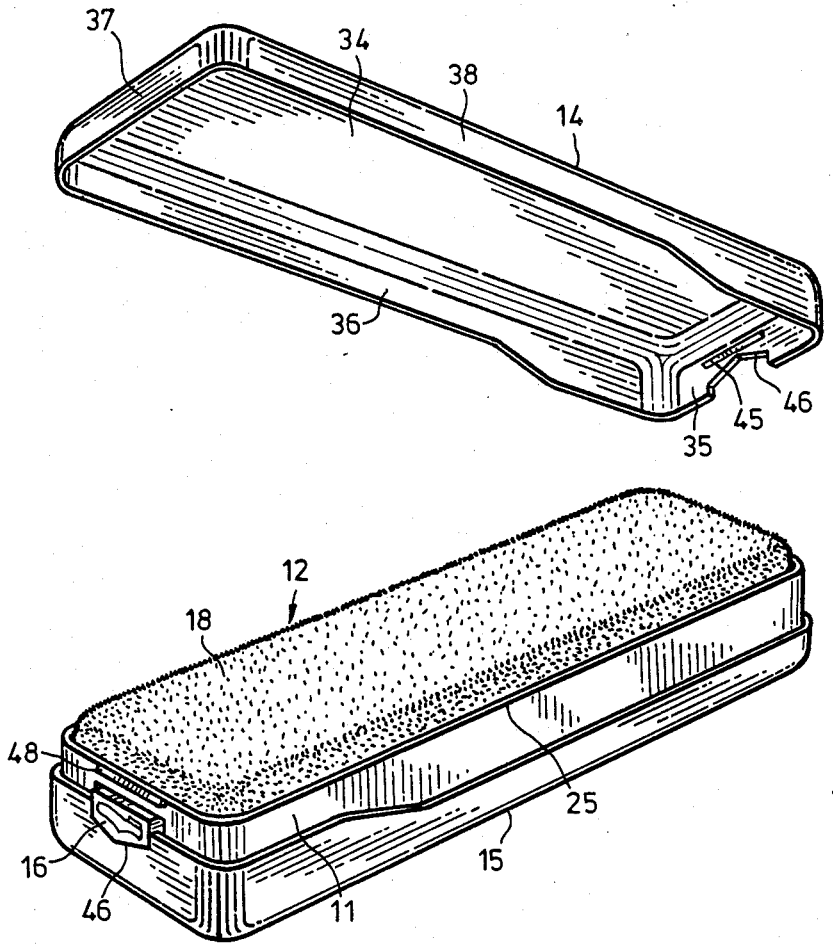

When access to shoe polishing brush 13 is required, finger 39 of latch member 16 bearing the indicia of a shoe and pointing at cover 15 is depressed releasing projection 43 from its engagement in recess 45 and permitting cover 15 to be removed, as shown in FIG. 5. In a preferred embodiment of the invention the spongy material of shoe polishing brush 13 is of such a depth and resilience that it is compressed when cover 15 is put in place. Thus, when finger 39 of latch 16 is depressed, cover 15 will spring off as the spongy material of shoe polishing brush 13 expands. Cover 15 may be replaced by inserting projection 48 (not shown) adjacent rim 29 into recess 47 (FIG. 5) in side wall 37 of cover 15 and then pivoting cover 15 into the position shown in FIG. 1, during which procedure finger 39 will depress slightly while projection 43 rides over the inner surface of side wall 35 of cover 15 ultimately engaging in recess 45.

Cover 14 may be similarly removed by operation of latch member 16 and similarly reinstalled. In this case no outward force is exerted by lint brush 12 on its cover 14.

While a preferred embodiment has been described and illustrated herein, the person skilled in the art will appreciate that changes and modifications may be made therein without departing from the spirit and scope of this invention as defined in the appended claims.

What I claim is:

1. A two-sided brush and container therefor comprising a body member having first and second oppositely disposed ends and first and second oppositely disposed faces; a first brush affixed to and extending from said first face; a second brush affixed to and extending from said second face and thus being oppositely disposed to said first brush; first and second covers respectively cooperating with said body member to house said first and second brushes respectively in first and second compartments respectively formed between said first cover and said body member and between said second cover and said body member respectively, each of said covers at one end thereof being of greater depth than at the other end thereof, such that if said covers are mounted on said body member with the deeper ends adjacent to each other, said deeper ends will abut each other and preclude said covers from being latched to said body member; first and second latch members at said first and second ends respectively of said body member, said first latch member being formed integral with said body member and comprising a cantilevered finger having a first detent thereon engageable with a second detent on said first cover, said second latch member being formed integral with said body member and comprising a cantilevered finger having a third detent thereon engageable with a fourth detent on said second cover; and detent means on said body member and on said cover members remote from said first and third detents and from said second and fourth detents respectively for removably securing said covers to said body member.

2. The invention according to claim 1 wherein said first brush is a shoe polishing brush and said second brush is a lint removing brush.

3. The invention according to claim 1 wherein said cantilevered fingers are formed by two, parallel, spaced-apart slits in each of said ends of said body member.

4. The invention according to claim 1 wherein said first and third detents are projections and said second and fourth detents are recesses for receiving said first and third projections respectively.

5. The invention according to claim 4 wherein said detent means are projections on said body member and recesses in said covers for receiving said projections of said detent means.

6. The invention according to claim 2 including means for mounting said lint removing brush in only one way with respect to said second face, and direction indicating means on said body member indicating the required direction of movement of said lint removing brush to remove lint from clothes.

7. The invention according to claim 2 wherein said shoe polishing brush is of a compressible, resilient material and is of sufficient depth that it is compressed between said first cover and said body member and thus facilitates removal of said first cover by expanding as said first cover is removed.

8. The invention according to claim 1 wherein one of said brushes is adhered to one of said faces of said body member, said one face being provided with ribs thereon to reduce the degree of adhesion between said one brush and said one face.

9. The invention according to claim 8 wherein the density of said ribs is greater adjacent each end of said one brush than adjacent the centre of said one brush to facilitate peeling off of said one brush from said one face.

10. The invention according to claim 8 wherein said one brush is adhered to said one face by double-sided adhesive tape.

11. The invention according to claim 8 wherein said one brush is said shoe polishing brush.

12. The invention according to claim 10 wherein said one brush is said shoe polishing brush and wherein the density of said ribs is greater adjacent each end of said one brush than adjacent the centre of said one brush to facilitate peeling off of said one brush from said one face.

13. The invention according to claim 1 wherein said latch members include means for indicating which of said covers is secured by said latch member.

14. The invention according to claim 13 wherein said indicating means is an arrow pointing to the one of said covers that is secured by said latch member.

15. The invention according to claim 2 including first indicia on said first latch member indicating that it is securing said first cover for said shoe polishing brush and second indicia on said second latch member indicating that it is securing said second cover for said lint removing brush.

16. The invention according to claim 15 wherein said first indicia is a depiction of a shoe and said second indicia is a depiction of a clothes hanger.

* * * * *